US007494429B2

(12) United States Patent
Lee

(10) Patent No.: US 7,494,429 B2
(45) **Date of Patent: *Feb. 24, 2009**

(54) GOLF TEE WITH A MOMENTARILY RELEASABLE UPPER BODY; EQUIPPED WITH TWO RETRACTING SPRINGS AT THE MOMENT OF IMPACT

(76) Inventor: Hyung Choon Lee, 86-18, Dodang-Dong, Wonmi-Ku, Buchon, Kyunggi-Do (KR)

( * ) Notice: Subject to any disclaimer, the term of this patent is extended or adjusted under 35 U.S.C. 154(b) by 0 days.

This patent is subject to a terminal disclaimer.

(21) Appl. No.: 10/847,533

(22) Filed: May 18, 2004

(65) Prior Publication Data

US 2007/0111825 A1 May 17, 2007

(51) Int. Cl.
*A63B 57/00* (2006.01)

(52) U.S. Cl. ..... 473/396; 473/401
(58) Field of Classification Search ..... 473/387–403, 473/575, 576
See application file for complete search history.

(56) References Cited

U.S. PATENT DOCUMENTS

| | | | | |
|---|---|---|---|---|
| 2,839,304 | A * | 6/1958 | Lerick | 473/397 |
| 3,079,158 | A * | 2/1963 | Finn et al. | 473/396 |
| 4,418,916 | A * | 12/1983 | Matsuura | 473/396 |
| 4,524,974 | A * | 6/1985 | Matsuura | 473/396 |
| 5,242,170 | A * | 9/1993 | Ward | 473/396 |
| 5,413,348 | A * | 5/1995 | Basso | 473/393 |
| 5,853,339 | A * | 12/1998 | Scerbo | 473/576 |
| 6,783,470 | B2 * | 8/2004 | Lee | 473/401 |

* cited by examiner

*Primary Examiner*—Steven Wong
(74) *Attorney, Agent, or Firm*—Birch, Stewart, Kolasch & Birch, LLP

(57) ABSTRACT

A golf tee for separating the upper body and the lower pin body at the impact moment. The tee has increased re usability. The tee has two springs inside. One spring is inside of an upper head body made of a transparent and flexible outer layer having a golf ball placement at the top. The other spring is embedded in a plastic pin. Those springs are connected by a flexible polymer string connector, which is inserted inside of the springs. Both ends of the flexible plastic string connector has a diameter larger than that of the springs to hold the upper end of the spring in the upper body and the lower end of the other spring in the pin. The springs, inside of the upper head body and inside of the pin, retract at the impact moment.

8 Claims, 5 Drawing Sheets

GOLF TEE WITH A MOMENTARILY RELEASABLE UPPER BODY; EQUIPPED WITH TWO RETRACTING SPRINGS AT THE MOMENT OF IMPACT

This device relates to a golf tee, more particularly a golf tee used to improve the traveling distance of a struck golf ball and maximizing the ability to re-use of the tee.

BACKGROUND OF THE INVENTION

Most golf tees are made of solid plastic or wood in one body. Various flexible golf tees have been introduced utilizing flexible plastics, springs, and adjustable pinheads. However, all of the prior arts have at least one of the drawbacks of a strong resistance, fast deterioration of the resilience of the flexible body, and the need to constantly re-align the pin and head of a tee after each use.

RELATED PRIOR ART

U.S. Pat. No. 2,531,470 to Rickard, U.S. Pat. No. 4,645,208 to Morabeto, U.S. Pat. No. 5,242,170 to Ward illustrate golf tees, whose upper bodies are separated from the lower bodies of pin at the moment of impact. Among them '470 tee may returns to the upright position after impact. However, the resilient coefficient of the elastic up-standing rubber shank 10 acts as a strong resistance. The upper body is easily separated from the lower body if the player hits the tee too strongly. In the other two cases, the upper bodies have to be re-aligned to the upright position by a player after each use.

U.S. Pat. No. 2,146,736 to Hammond et al., U.S. Pat. No. 2,470,817 to Hendricks, and U.S. Pat. No. 2,839,304 to Lerick illustrate heads for adjustable golf tees that are returned to the upright position by a resilient force of a rubber band or a spring embedded in a hollow straight upper body. In these designs, the spring or rubber band meets additional friction from the inner wall of the hollow straight upper body. Repeated exposure to such hard impact and to the elongation direction of the spring or rubber band that is greater than the yielding point of the spring easily deforms the spring to alter the resiliency of the tee.

U.S. Pat. No. 1,519,298 to De Mun, U.S. Pat. No. 2,440,473 to Hughes, U.S. Pat. No. 4,976,431 to Guenther illustrate golf tees utilizing spirally wound springs. They are almost the same invention in terms of that the spring constitutes the head and upper body of a tee except the pin. Repeated impact to the direction of elongation of the spring easily deforms the spring from its original physical properties, such as its resilient coefficient.

U.S. Pat. No. 2,839,304 to Lerick, U.S. Pat. No. 4,524,974 Matsuura, and U.S. Pat. No. D430,913 to Lovelace illustrate a golf tee comprised of an upper body and lower body connected by a spirally wound spring. In those three arts, the spring elongates when hit by a driver. If the impact of the hit is greater than the yielding point on the spring's stress-strain curve, the tee does not maintain its original resiliency any longer. In '974 (Matsuura) case, the thermally treated plastic spring 12 (FIG.3) serves as a string which connects the head after it falls on the ground after the ball is struck. So the player is required to realign the tee head and pin to reuse it.

U.S. Pat. No. 4,989,896 to Lackey introduces a golf tee utilizing a retractable spring 53 in a tee, which has an upper body made of flexible plastic and a lower body made up of rigid material. The role of spring 53 in the tee is to engage and retract the metal spikes 7 to and from the slots 5 developed at the side of the lower pin portion 2 of the tee. However, the upper and lower bodies are not separated after the tee is used. Moreover, the resistance of the tee is very high due to the metal rod 37 embedded in the tee from the top to the bottom. The spring also extends when a player hits a ball off of this tee.

None of the prior arts provide a golf tee equipped with a spirally wound springs inside of the upper body and the pin, which retract at the impact moment to maintain the resilient coefficient of the spring for a longer period of time, and reduce the resistance of the tee by momentarily being separated into two parts of the upper body and the lower body at the same time.

SUMMARY OF THE INVENTION

The present invention provides a golf tee for increasing the traveling distance of golf ball and having increased reusability. Due to its unique design, it is not necessary to realign the tee head and pin, which is critical to the other head and pin separable tees. The tee is comprised of; 1) an upper head body, which is composed of a spirally wounded metal spring that retracts at the moment of impact, a flexible polymer string connector inserted inside of the spring and connected to another spring embedded inside of a pin by penetrate the another spring, and a transparent and flexible outer layer used for the golf ball placement; and 2) a plastic pin having a void for receiving another spirally wounded metal spring and the lower part of the flexible polymer string inside of the spring. Both ends of the flexible plastic string connector have diameters larger than that of the springs to hold the upper end of the spring in the upper body and the lower end of the other spring in the pin. The upper body is released from the pin momentarily at the moment of impact to minimize the resistance of the tee but allows it to return to its original position immediately. This unique motion of the tee increases the flying distance of the golf ball though the player hit the tee by mistake. The springs, inside the upper head body and the pin, retract at the moment of impact. It prevents rapid deformation of the spring after hard moments of impact, extends the life of the flexible polymer string connector and the tee. The golf tee as the current application increases the flying distance of a golf ball by yielding the upper body to a driver at a "tee-off" moment and returns to its original formation by itself. An additional holding pin is connected to the tee to prevent losing it if it is struck improperly.

DETAILED DESCRIPTION OF THE PREFERRED EMBODIMENT

Figure 1:
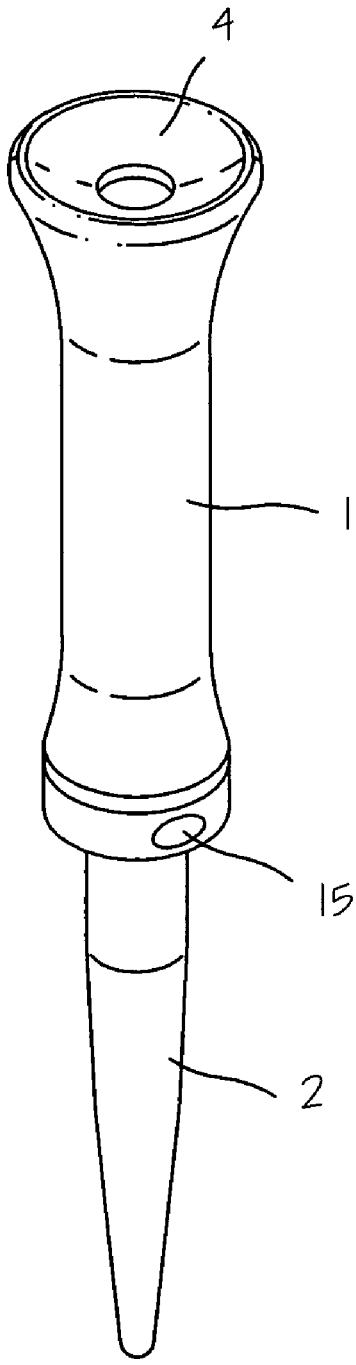
FIG. 1 is a perspective view of the golf tee as the current application.

FIG. 1 is a perspective view of the golf tee as the current invention. The golf tee is comprised of an upper head body (1), a lower pin body (2) and a mount for golf ball placement (4). The outer layer (1-*a*) of the upper head body (1) is made up of transparent flexible Elastomer of, including but not limited to, polyurethane, elastic poly-vinyl-chloride, and Tygon®. The lower pin body (2) is made up of rigid plastic of, including but not limited to, polystyrene, polyvinyl chloride, polyethylene, and polypropylene.

Figure 2:
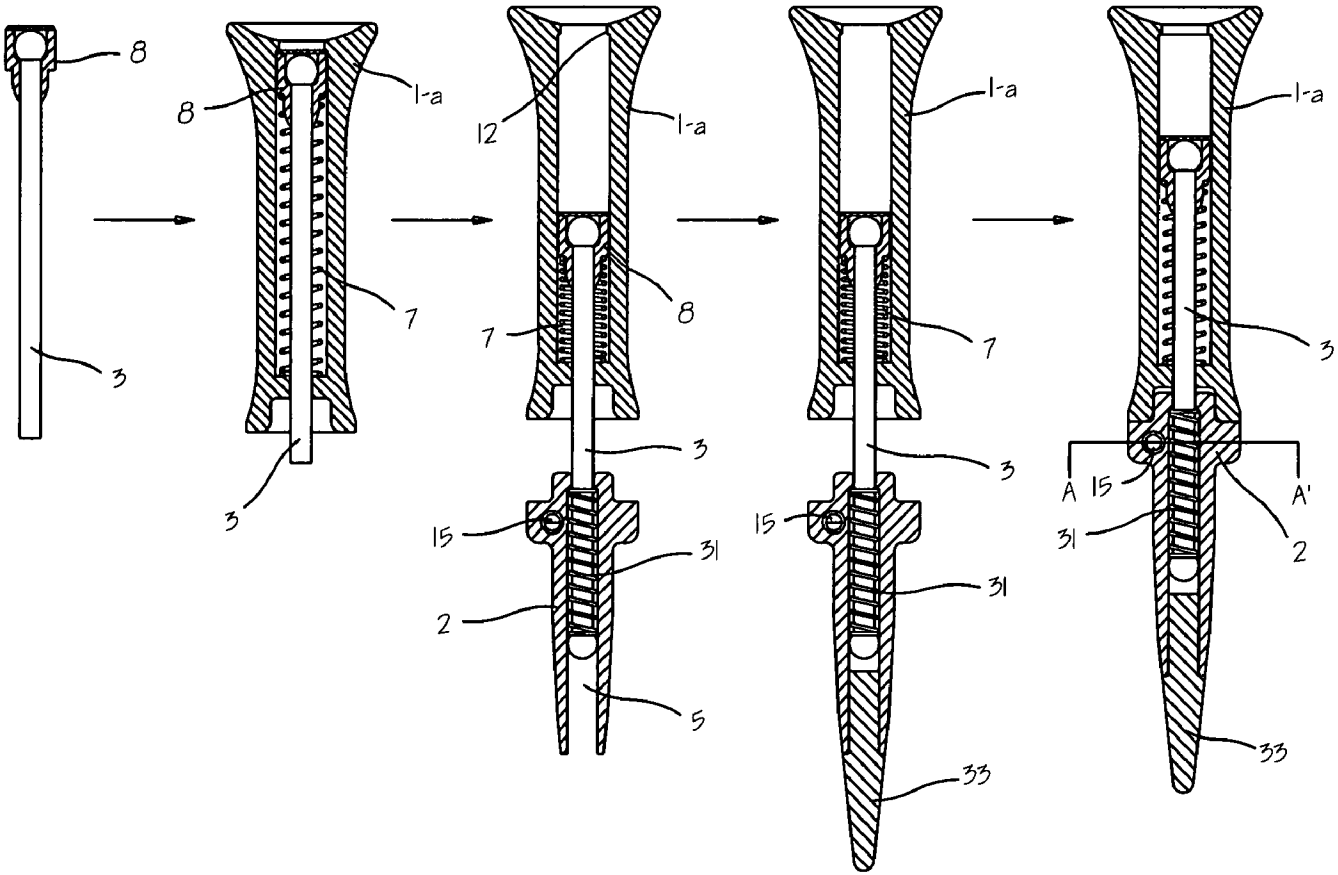
FIG. 2 shows assemblying step of the golf tee the current application in a cross sectional view.

FIG. 2 shows assemblying step of the golf tee the current application in a cross sectional view. A flexible polymer string connector (3), one end of which has a round tip with a diameter larger than that of the spirally wounded spring (7), is inserted into the spring (7) and passed through a support head (8) that has a round bottom. The round tip of the polymer string connector (3) is held by the support head (8). The lower end of the polymer string connector (3) passes through the support head (8) and spring (7). The lower end of the polymer string connector (3) pass through the lower pin body (2), which has a cylindrical channel (5) developed to the lower end. Another spring (31) is inserted between the polymer string connector (3) and the lower pin body (2). Then the lower end of polymer string connector (3) is made round by heat melting. To this lower end a pin tip (33) is inserted and fixed by a glue. A hole (15) for the string, which is connected to an additional pin, is developed on the head portion of the lower pin body (2).

Figure 3:
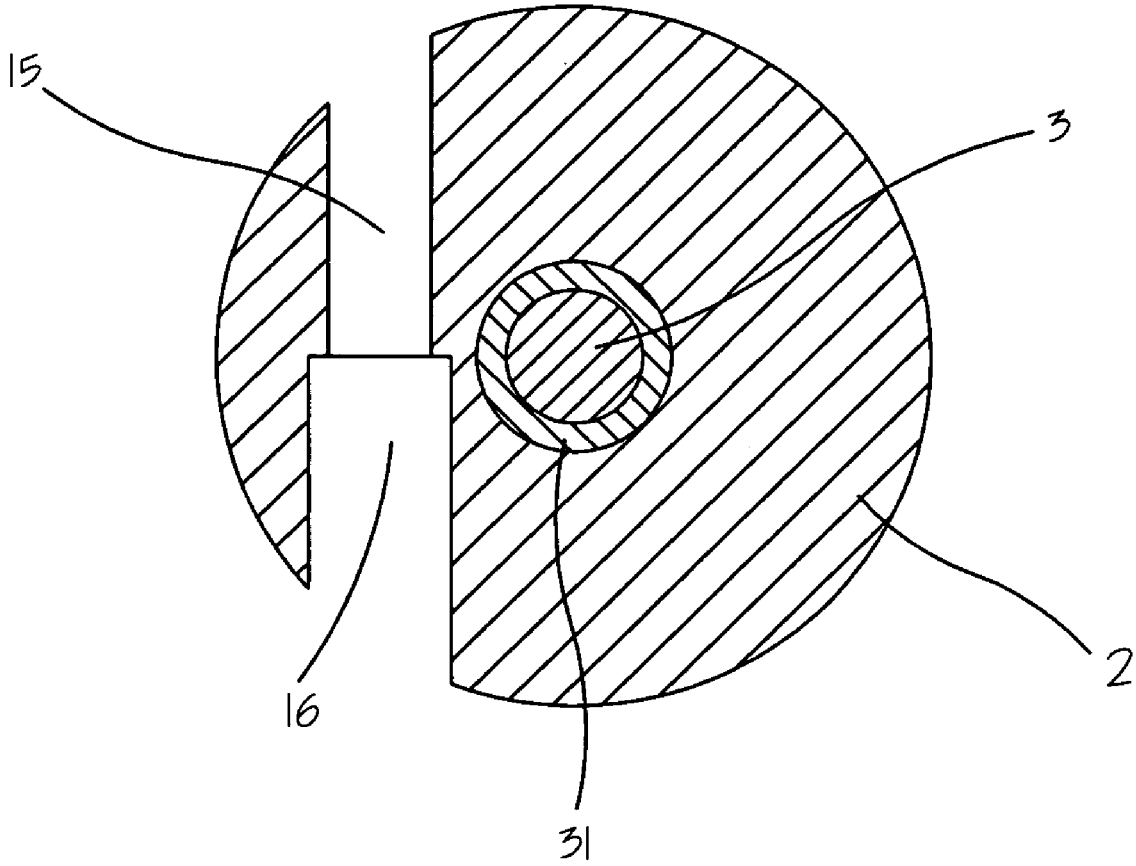
FIG. 3 is a cross sectional view of the head of the lower pin body along the cross section of A-A' in FIG. 2.

FIG.3 is a cross sectional view of the golf tee as the current invention. The outer layer (1-*a*) of the upper head body (1) has a widened head end for golf ball placement (4). The inside of the outer layer (1-*a*) is hollow to receive contracted spring (7), the connector (3), and the support head (8). The lower part of the outer layer (1-*a*) has a projection developed inward (6) to hold the spring (7). Likewise the upper part of the outer layer includes a projection (12) extending inward. The lower bottom of the outer layer is slightly widened to match with the upper end of the lower pin body (2).The lower end (10) of the connector (3) and the metal support pin (13) is embedded in the cavity (5) formed in the lower pin body (2). A hole (15) for the string, which is connected to an additional pin, is developed on the head portion of the lower pin body (2).

Figure 4:
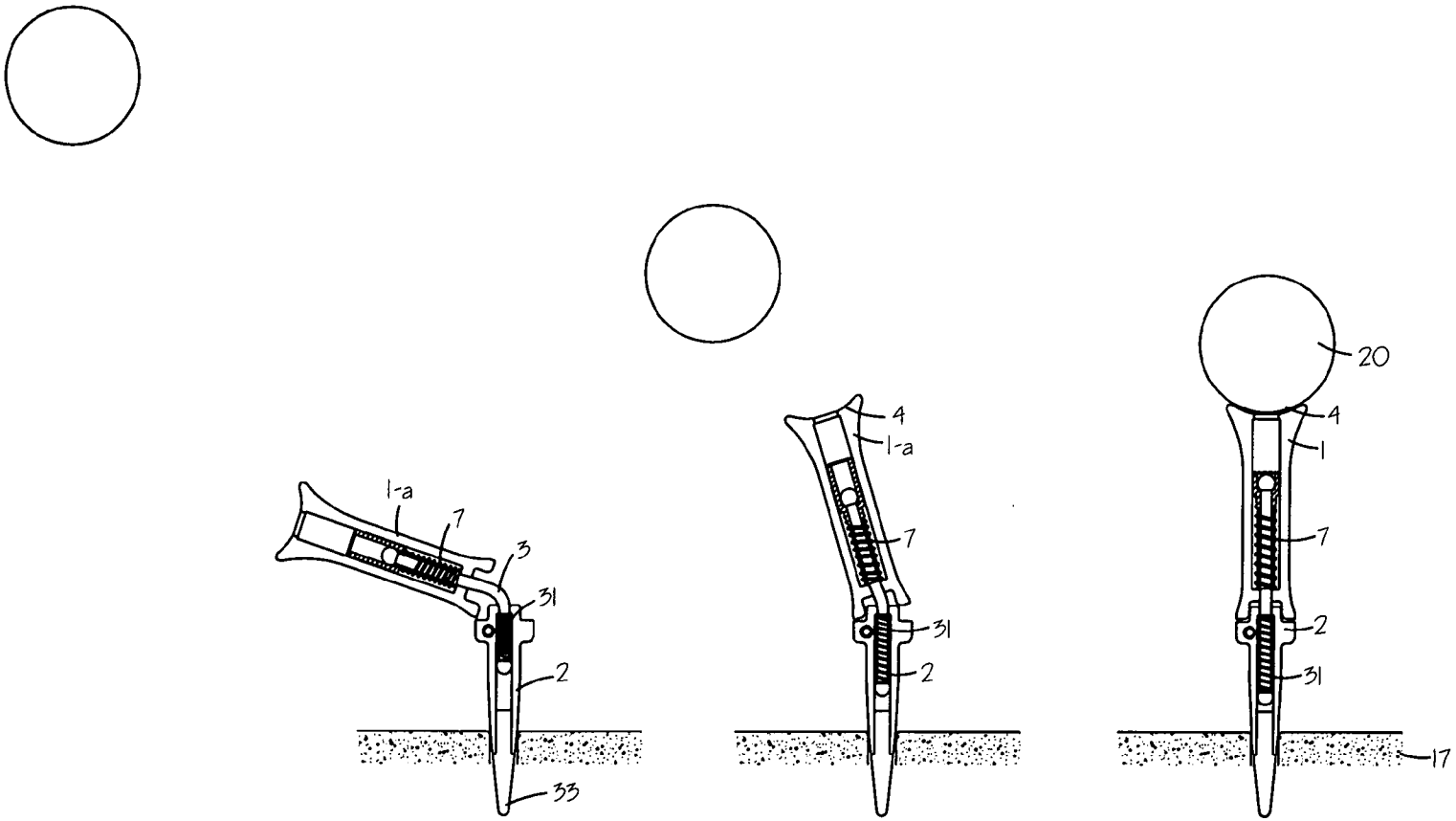
FIG. 4 is a dynamic cross sectional view of the tee at the moment of the golf ball being struck.

FIG. 4 is a dynamic cross sectional view of the tee at the moment of a ball being struck showing how the springs (7), in the upper head body (1), and (31) in the lower pin body (2) change in shape and how it functions. When a golf player places a tee in the ground (17) and places a golf ball (20) on the placement (4) on of the tee, the spring (7) in the upper head body (1) and (31) in the lower pin body (2) are at its normal length. If the player hits only the golf ball (20), the tee remains as is. But, if the player hits the tee with a larger golf club, the upper head body (1) bends to the direction of golf ball's traveling direction due to the flexibility of the upper head body (1). If the tee's upper body is not flexible, the tee will be dislodged from the ground.

The upper head body (1) bends to any direction, 360 degree along a surface parallel to the ground, responding to an impact force and bounces back to the upright position immediately due to the reactive force of the retracted spring inside of the upper head body.

As the upper head body (1) bends to the golf ball's traveling direction, the opposite side of the upper head body (1) is lifted and separated from the lower pin body (2). Then the connector (3) draws the spring (7) down to leave the lower pin body (2) in position and allow the upper head body (1) bend away from the lower pin body (2). At the same time, the second spring (31) is drawn up by the connector (3). The connector (3) still connects the upper body (1) and lower pin body (2). Due to the flexibility of the springs (7) and (31), connector (3), and the outer layer (1-*a*) of the upper head body (1), the upper head body (1) bends smoothly and bounce back to an upright position just after the ball is struck.

In this step, the springs behave oppositely to that of the other springs in prior arts. All the springs applied to golf tees of prior arts elongates at the moment of impact. If the strength of the impact is greater than the yielding point, the spring deforms and does not return to its original status. Then the tee is not reusable. Although it may not be deformed after a single use, repeated exposure to such a force will rapidly deteriorate the resilient coefficient of the spring. But, the springs (7) and (31) installed in the current invention retract at the impact moment. It minimizes the deterioration of the resilient coefficient of the spring and extends the life of the springs installed in the golf tee.

Figure 5:
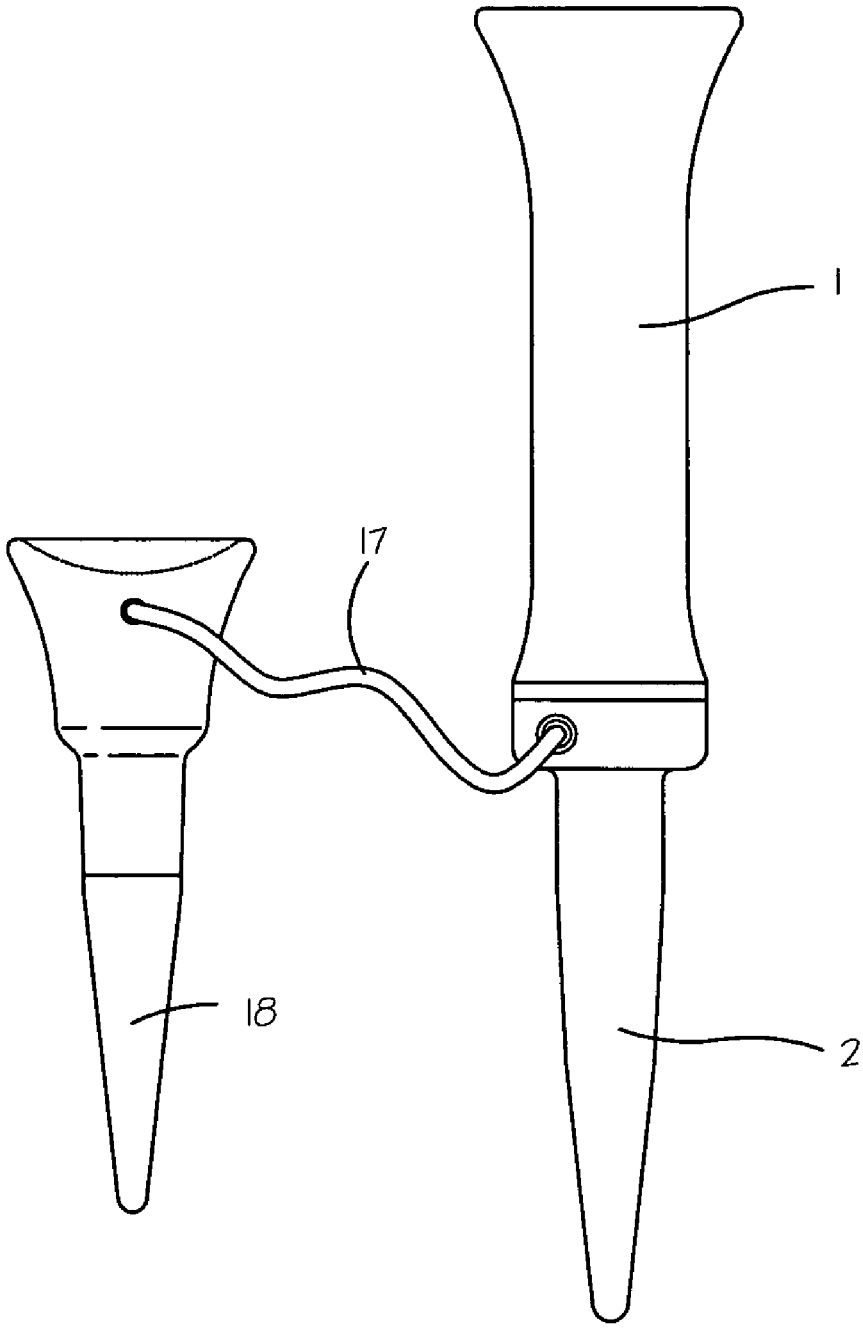
FIG. 5 is a schematic drawing of the golf tee as the current invention connected to an additional pin for holding the tee in place with a string in case of a dislodging.

FIG. 5 is a schematic drawing of the golf tee as the current invention connected to an additional pin (18) for holding the tee in place with a string (17) in case of a dislodging. If a player were to strike the lower center of the tee, the tee can be dislodged from the placement point and can travel a measurable distance. As a result, the additional pin (18) holds the tee in place and prevents the possible loss of the tee.

What is claim is:

1. A golf tee comprising:

an upper head body including, a first spring that contracts at the moment of impact, a flexible polymer string connector having a round tip inserted inside of the first spring that connects both of the first spring and a lower pin body, a tubular support head, said string connector passing through said support head with said round tip being received in said support head, and for bearing against a top of said first spring, and a transparent and flexible outer layer including a golf ball placement; and the lower pin body made up of rigid plastic, said lower pin body including a second spring connected to said lower pin body and said flexible polymer string connector, wherein said flexible polymer string connector has a lower end received in said second spring in a cavity of said lower pin body.

2. The golf tee of claim 1, wherein the upper head body and the lower pin body momentarily separate from each other but remain connected by the string connector.

3. The golf tee of claim 1, wherein the upper head body bends to any direction, 360 degree along a surface parallel to the ground, responding to an impact force and bounces back to the upright position immediately due to the reactive force of the retracted first spring installed inside of the upper head body.

4. The golf tee of claim 1, wherein the flexible polymer string connector has a spherical tip inserted inside the support head.

5. The golf tee of claim 1, wherein the upper head body has a longitudinal bore with a diameter, said support head having a diameter similar to said diameter of said bore, said first spring having a diameter smaller than the diameter of the support head, so that said first spring pushes said support head upwardly in said bore and is limited in its upward movement by said tip of said string connector.

6. The golf tee of claim 5, wherein the lower end of said string connector extends through said second spring and has a lower tip, the diameter of the lower tip being larger than diameter of said second spring to prevent its removal.

7. The golf tee of claim 1, wherein the lower pin body has a transverse bore with a larger diameter section and a smaller diameter section, the smaller diameter section receiving a string and the larger diameter section receiving a knot of the string to prevent its removal.

8. The golf tee of claim 7, wherein said string is also connected to an additional pin for retaining the tee in case of dislodging.

* * * * *